US006315581B1

(12) United States Patent
Yu

(10) Patent No.: US 6,315,581 B1
(45) Date of Patent: Nov. 13, 2001

(54) PRESS-FIT CONTACT FOR AN ELECTRICAL CONNECTOR

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/751,486

(22) Filed: Dec. 29, 2000

(51) Int. Cl.[7] ..... H01R 12/00
(52) U.S. Cl. ..... 439/82; 439/876
(58) Field of Search ..... 439/82, 84, 78, 439/873, 876

(56) References Cited

U.S. PATENT DOCUMENTS 3,941,449 * 3/1976 Baumanis ..... 439/876
4,076,356 * 2/1978 Tamburro ..... 439/82
4,368,944 * 1/1983 DeYoung ..... 439/82
4,381,134 * 4/1983 Anselmo et al. ..... 439/82
4,802,862 * 2/1989 Seidler ..... 439/876

* cited by examiner

*Primary Examiner*—Tho D. Ta
(74) *Attorney, Agent, or Firm*—Wei Te Chung

(57) ABSTRACT

A press-fit contact (1) for an electrical connector includes a retention portion (3), with a mating portion (2) and a tail portion (4) respectively extending from opposite ends of there retention portion. The tail portion is adapted to be inserted into a through hole (51) in a printed circuit board (5). The tail portion includes abase section (41) and a pair of arced engaging sections (42) extending from respective opposite side edges of the base section toward each other. Each engaging section defines a cutout (421) therein for providing resiliency.

3 Claims, 6 Drawing Sheets

PRESS-FIT CONTACT FOR AN ELECTRICAL CONNECTOR

BACKGROUND OF THE INVENTION

1. Field of the Invention

The present invention relates to a contact for an electrical connector, and particularly to a contact for an electrical connector for being press fitted into a corresponding through hole in a PCB (Printed Circuit Board) where the electrical connector is mounted.

2. Description of Prior Art

Two methods are commonly used in the connector field for connecting contacts of an electrical connector to a PCB defining a plurality of through holes for receiving the contacts therein. One method is to insert tail portions of the contacts into corresponding through holes of the PCB and then solder the tail portions thereto. However, the soldering process is inconvenient and tedious. Therefore, another method, i.e., press-fitting, is more readily applied by the manufacturers to facilitate assembly.

As is illustrated in FIGS. 4–6, a tail portion 61 of a conventional press-fitting type contact 6 is formed by stamping a hole 611 in the pre-formed tail portion of the contact 6. The hole 611 typically has an eye-of-needle shape. By simply press fitting the tail portion 61 of the contact 6 into a corresponding through hole 71 of the PCB 7, an electrical connection can be established between the contact 6 and the PCB 7. During the press-fit engagement, the tail portion 61 of the contact 6 is compressed by inner sides 72 of the corresponding through hole 71, whereby the tail portion 61 is plastically deformed for being securely engaged with the through hole 71.

However, one problem with this design is that the resiliency of the tail portion 61 of the contact 6 is insufficient, and therefore a large insertion force is required to insert the tail portion 61 into the through hole 71 of the PCB 7. Consequently, large interference forces may develop between the tail portion 61 and the through hole 71, which can damage the inner sides 72 of the through hole 71 of the PCB 7.

Hence, an improved press-fit contact is required to overcome the aforesaid disadvantages of the prior art.

SUMMARY OF THE INVENTION

Accordingly, the object of the present invention is to provide a press-fit contact having sufficient resiliency for facilitating insertion into a corresponding through hole of a PCB, thereby preventing damage to inner sides of the through hole.

In order to achieve the object set forth, a press-fit contact for an electrical connector in accordance with the present invention comprises a retention portion, with a mating portion and a tail portion respectively extending from opposite ends of the retention portion. The mating portion is adapted to mate with a corresponding contact of a complementary electrical connector, and the tail portion is adapted to be inserted into a corresponding through hole of a PCB. The tail portion includes a base section and a pair of arced engaging sections extending from respective opposite side edges of the base section toward each other. A cutout is defined in each engaging section for providing resiliency to the engaging section. A ramp is defined by a lower edge of each engaging section for facilitating insertion into the through hole of the PCB, thereby preventing damage to inner sides of the through hole.

Other objects, advantages and novel features of the invention will become more apparent from the following detailed description when taken in conjunction with the accompanying drawings.

DETAILED DESCRIPTION OF THE INVENTION

Figure 1:
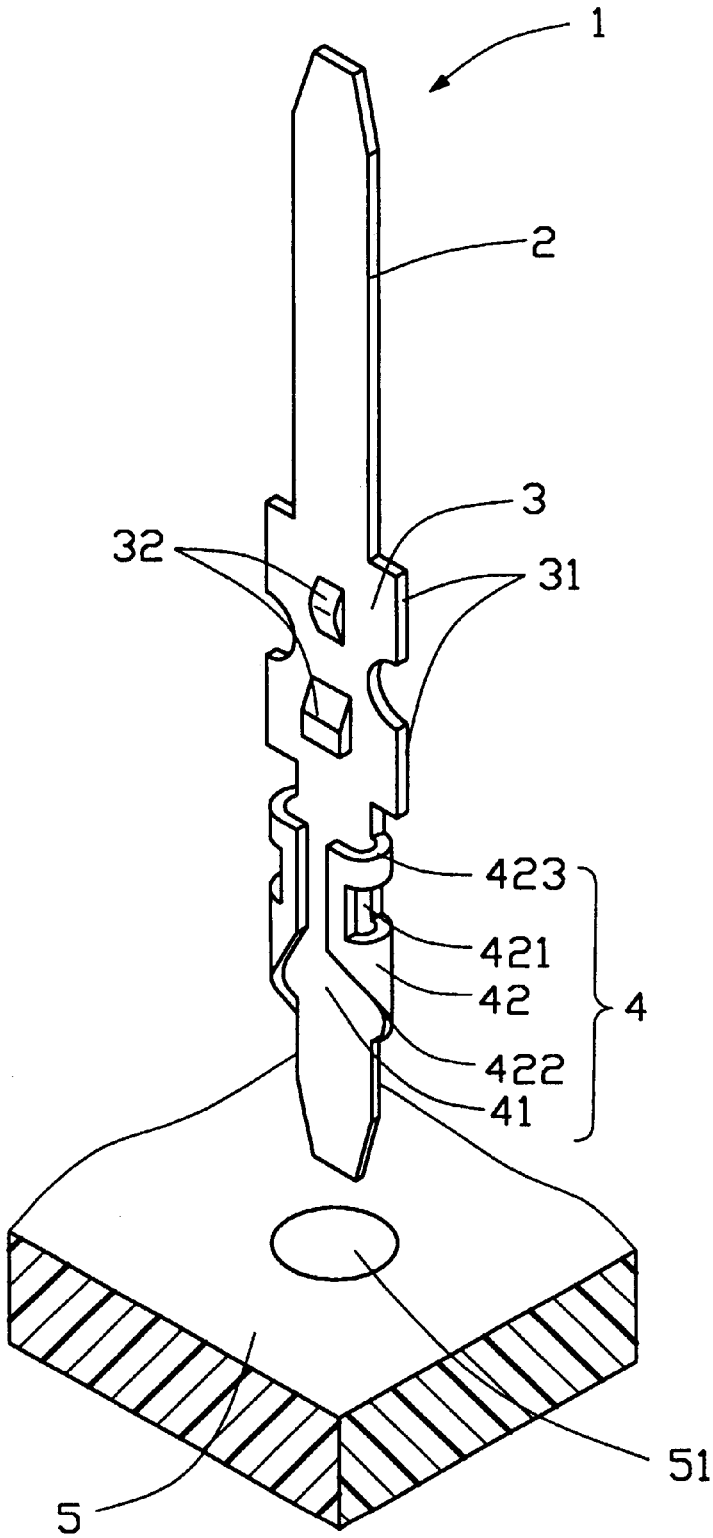
FIG. 1 is a perspective view of a PCB and a press-fit contact of the present invention ready to be inserted into a corresponding though hole of the PCB.

Reference will now be made to the drawing figures to describe the present invention in detail.

Figure 2:
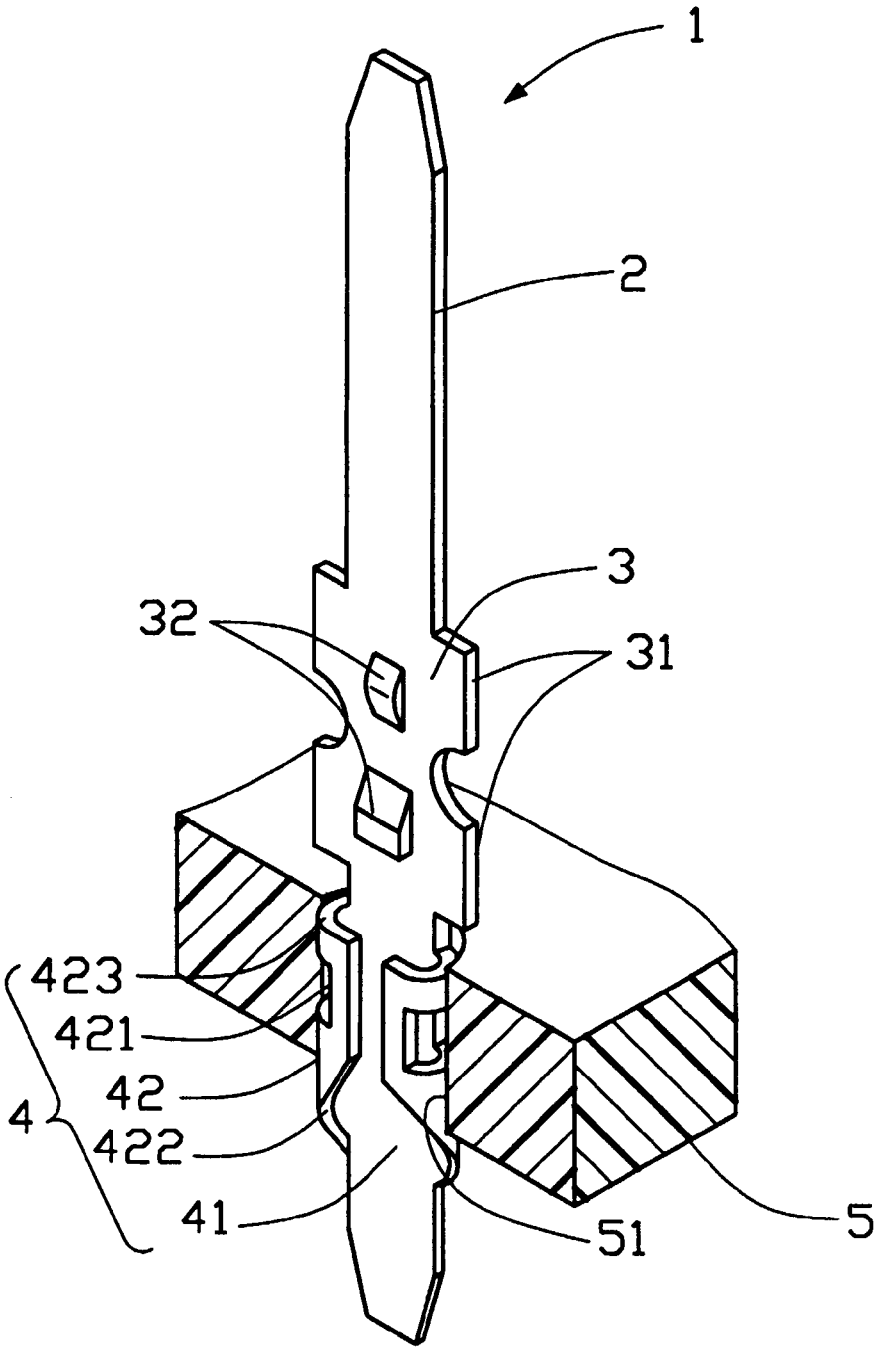
FIG. 2 is a perspective view of a PCB and a press-fit contact of the present invention inserted into a corresponding though hole of the PCB.
Figure 3:
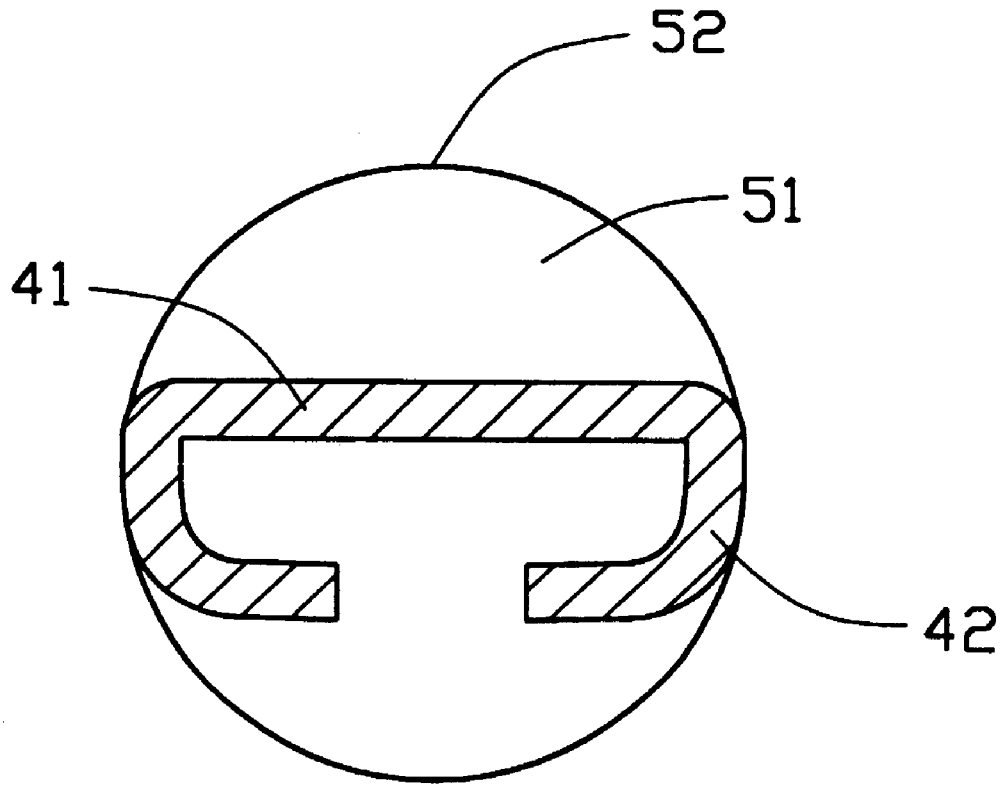
FIG. 3 is a cross-sectional view illustrating the engagement between a tail portion of the press-fit contact of the present invention and the corresponding through hole of the PCB.

Referring to FIGS. 1–3, a press-fit contact 1 for an electrical connector (not shown) in accordance with the present invention comprises a retention portion 3, with a mating portion 2 and a tail portion 4 respectively extending from opposite ends of the retention portion 3. The retention portion 3 includes tabs 31 and protrusions 32 for securing the contact 1 to an insulative housing (not shown) of the electrical connector. The mating portion 2 is adapted for mating with a corresponding contact of a complementary electrical connector (not shown), and the tail portion 4 is adapted for being inserted into a corresponding through hole 51 in a PCB 5.

The tail portion 4 includes a base section 41 and a pair of engaging sections 42 extending from respective opposite side edges of the base section 41. The engaging sections 42 are bent toward each other in the shape of an arc. A cutout 421 is stamped in each engaging section 42 for providing resiliency to the engaging section 42. Each engaging section 42 has a lower edge 422 upwardly inclining toward a top edge 423 thereof to define a ramp when bent, thereby facilitating insertion of the tail portion 4 into the corresponding through hole 51 of the PCB 5.

Figure 4:
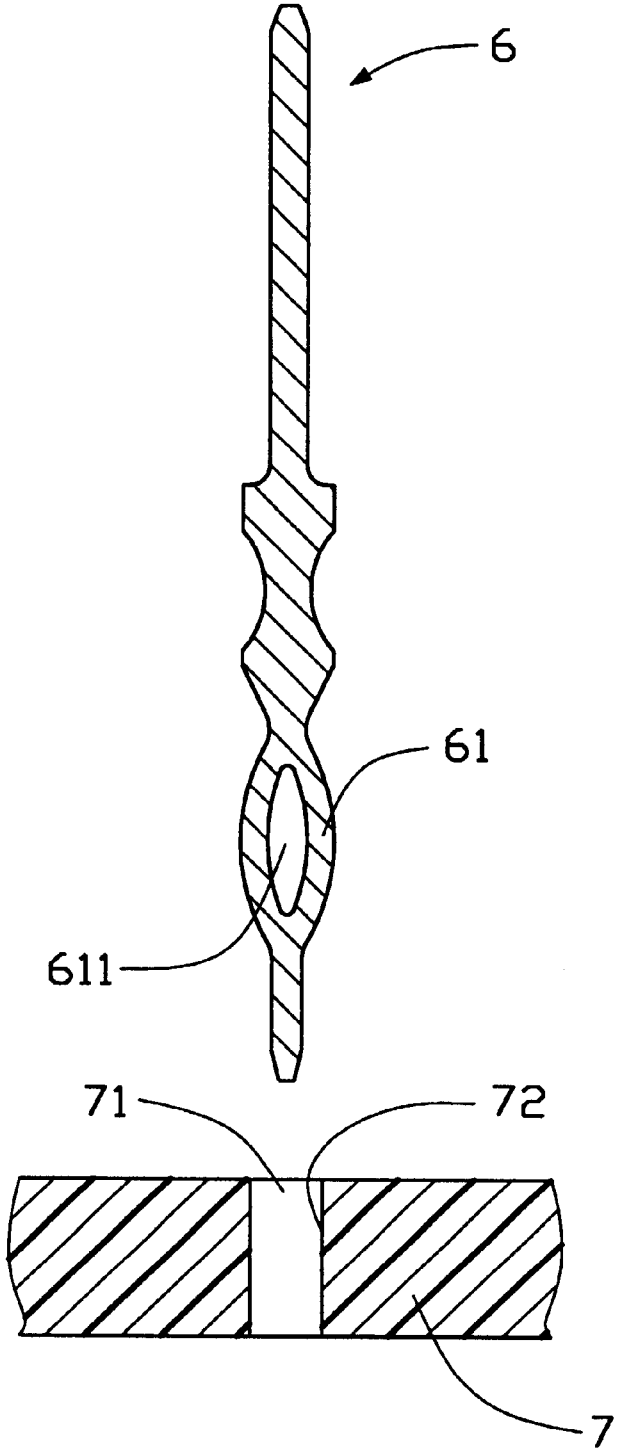
FIG. 4 (PRIOR ART)
FIG. 4 is a cross-sectional view of a PCB and a conventional press-fit contact ready to be inserted into a corresponding though hole of the PCB.
Figure 5:
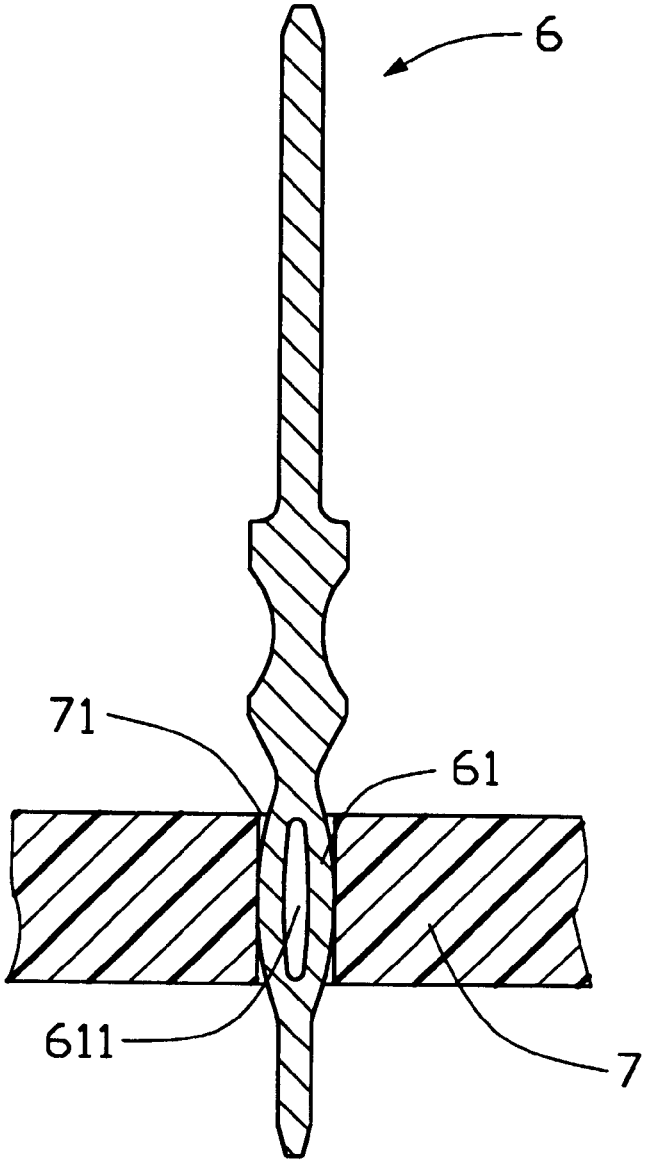
FIG. 5 (PRIOR ART)
FIG. 5 is a cross-sectional view of a PCB and a conventional press-fit contact inserted into a corresponding though hole of the PCB.
Figure 6:
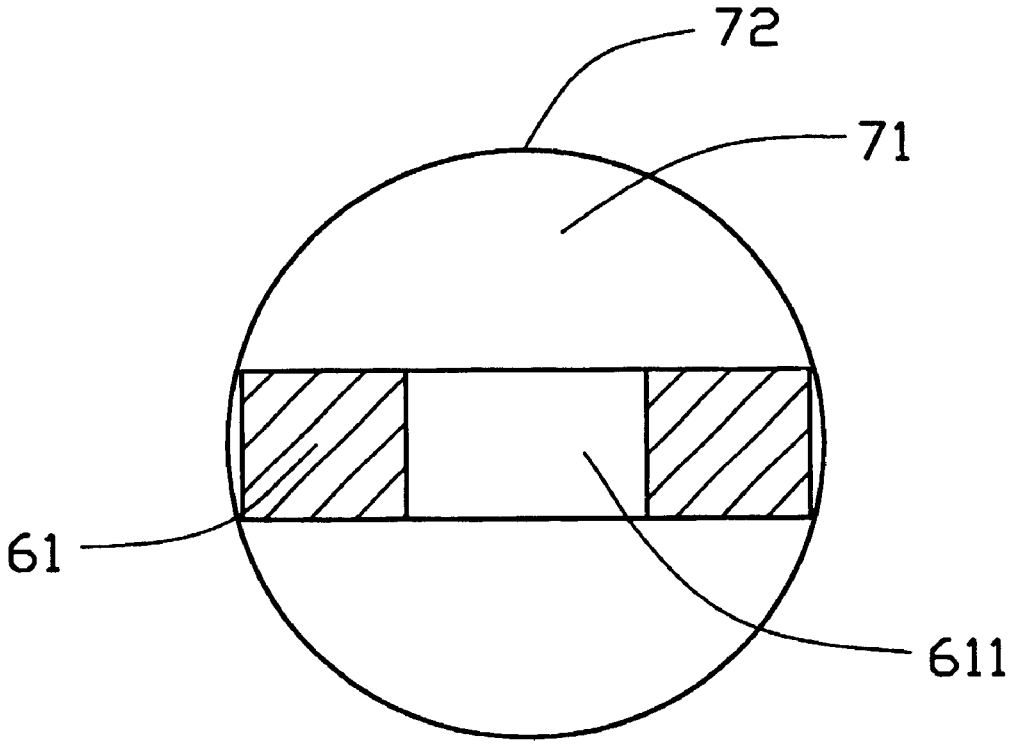
FIG. 6 (PRIOR ART)
FIG. 6 is a cross-sectional view illustrating the engagement between a tail portion of the conventional press-fit contact and the corresponding through hole of the PCB.

By the provision of the curved engaging sections 42 and cutouts 421, sufficient resiliency is provided to the engaging sections 42 of the tail portion 4, whereby a low insertion force is required to insert the tail portion 4 into the through hole 51 compared to the conventional press-fit contact design shown in FIGS. 4–6. As a result, damage to inner sides 52 of the through hole 51 of the PCB 5 can be efficiently prevented.

It is to be understood, however, that even though numerous characteristics and advantages of the present invention have been set forth in the foregoing description, together with details of the structure and function of the invention, the disclosure is illustrative only, and changes maybe made in detail, especially in matters of shape, size, and arrangement of parts within the principles of the invention to the full extent indicated by the broad general meaning of the terms in which the appended claims are expressed.

What is claimed is:

1. A press-fit contact for an electrical connector comprising a retention portion, a mating portion and a tail portion, the mating portion and the tail portion respectively extending from opposite ends of the retention portion, the tail portion 15 press-fitted into a corresponding through hole of a printed circuit board (PCB), the tail portion including a base section and a pair of arced engaging sections respectively extending from opposite side edges of the base section, each engaging section defining a cutout providing resiliency to the engaging section during press-fit engagement between the tail portion and the corresponding through hole of the PCB, said cutouts separating the engaging sections into opposite upper sections and opposite lower sections received in a common through hole of the PCB after said press-fit engagement, said opposite upper sections as well as said opposite lower sections defining an outer diameter larger than the diameter of the corresponding through hole of the PCB before said press-fit engagement.

2. The press-fit contact as described in claim 1, wherein the engaging sections of the tail portion extend toward each other.

3. The press-fit contact as described in claim 1, wherein each engaging section of the tail portion has a lower edge upwardly inclining toward a top edge thereof.

* * * * *